US005522438A

United States Patent [19]

Gustafsson et al.

[11] Patent Number: 5,522,438

[45] Date of Patent: Jun. 4, 1996

[54] APPARATUS FOR FILLING PACKAGING CONTAINERS

[75] Inventors: Per Gustafsson, Formigine-Modena; Paolo Fontanazzi, Modena, both of Italy

[73] Assignee: Tetra Brik Research & Development SPA, Modena, Italy

[21] Appl. No.: 295,059

[22] Filed: Aug. 26, 1994

[30] Foreign Application Priority Data

Sep. 7, 1993 [IT] Italy ..... MI93A1913

[51] Int. Cl.[6] ..... B65B 3/00

[52] U.S. Cl. ..... 141/196; 141/192; 141/1; 141/179; 141/244

[58] Field of Search ..... 141/178, 179, 141/184, 185, 1, 153, 181, 192, 196, 237, 242–246, 284

[56] References Cited

U.S. PATENT DOCUMENTS

| | | | |
|---|---|---|---|
| 1,987,580 | 1/1935 | Schneider | 141/244 X |
| 2,167,624 | 8/1939 | Brodsky | 141/244 X |
| 2,263,551 | 11/1941 | Armstrong et al. | 141/181 X |
| 2,791,353 | 5/1957 | Dorn et al. | 141/244 X |
| 4,000,765 | 1/1977 | Lydiksen | 141/181 |
| 4,313,476 | 2/1982 | Bennett et al. | 141/181 X |
| 4,401,141 | 8/1983 | Rosen et al. | 141/192 |
| 4,411,295 | 10/1983 | Nutter | 141/237 X |
| 4,674,547 | 6/1987 | Simonazzi | 141/181 X |
| 4,817,688 | 4/1989 | Corniea . | |
| 4,838,462 | 6/1989 | Corniea . | |
| 4,840,205 | 6/1989 | Drevfors et al. . | |
| 4,869,397 | 9/1989 | Corniea et al. . | |
| 5,025,991 | 6/1991 | Stainbrook et al. . | |
| 5,287,997 | 2/1994 | Rodrigue et al. . | |

FOREIGN PATENT DOCUMENTS

| | | |
|---|---|---|
| 0196410 | 10/1986 | European Pat. Off. . |
| 0287179 | 10/1988 | European Pat. Off. . |
| 0515960 | 12/1992 | European Pat. Off. . |

*Primary Examiner*—J. Casimer Jacyna
*Attorney, Agent, or Firm*—Burns, Doane, Swecker & Mathis

[57] ABSTRACT

An apparatus for filling a plurality of containers with a liquid includes a holding tank for holding a quantity of liquid and a plurality of filler pipes connected to the holding tank. A plurality of filler valves are provided, each filler valve corresponding to one of the plurality of filler pipes. A flowmeter is provided, located between the holding tank and one of the filler valves in one of the plurality of filler pipes, for generating a signal after a predetermined amount of liquid has flowed through the filler pipe. A device, responsive to the signal generated by the flowmeter, is provided for closing the plurality of filler valves.

12 Claims, 2 Drawing Sheets

APPARATUS FOR FILLING PACKAGING CONTAINERS

TECHNICAL FIELD

The present invention relates to an apparatus for the simultaneous filling of a plurality of packaging containers with liquid contents, the apparatus comprising a holding tank provided with a level meter, filler pipes connected to the tank and a filler valve associated with each filler pipe.

BACKGROUND ART

In filling machines used in the brewing and dairy industries, the requirements on high filling capacity, precise filling accuracy, acceptable washing and sterilization capability and overall economy are of decisive importance. Filling machines for, for instance, bottles often fill a large number of bottles simultaneously, in which event each bottle is advanced by means of a conveyor to a filling station beneath a filler pipe through which a metered quantity of the desired contents is fed. Each filler pipe is, therefore, connected to a holding tank for the intended contents via a metering or dispensing device, e.g., a piston pump which, in each working stroke, measures and transfers the desired volume of contents from the holding tank to the bottle. In the event of contents of low viscosity, e.g., freely running liquids such as milk and juice, it is possible, instead of the relatively expensive and complex piston pump, to provide each filler pipe with a flowmeter and a valve controlled by the flowmeter, the valve opening when the bottle has been placed in the correct filling position beneath the filler pipe and closing when the flowmeter has measured the passage of the desired volume of contents.

Both of the above-outlined design and construction principles are generally employed and have proved to satisfy adequately the established requirements on efficiency, accuracy and washing capability. However, the costs involved (in particular in large scale filling plants) are relatively high since each filler pipe must be fitted with its own piston pump or flowmeter. Since large-scale filling plants featuring 8, 16 or 32 filler pipes are not uncommon, the capital investment costs will be considerable. In addition, the large number of piston pumps or flowmeters requires meticulous individual adjustment and control, which also correspondingly increases running costs.

OBJECTS OF THE INVENTION

One object of the present invention is to provide an apparatus for filling a plurality of packaging containers, the apparatus not suffering from the above-outlined drawbacks inherent in prior art apparatuses, but displaying a considerably more simplified design and construction.

A further object of the present invention is to provide an apparatus for filling packaging containers, the apparatus having a minimal number of component parts and being of simple design and construction.

Yet a further object of the present invention is to provide an apparatus for filling packaging containers, the apparatus having low running costs, and being easy to adjust to an accurate, stable level of precision.

Still a further object of the present invention is to provide an apparatus for filling packaging containers which is easy to wash and makes for a high level of hygiene.

SOLUTION

The above and other objects have been attained according to the present invention in that an apparatus of the type described by way of introduction includes a flowmeter is located between the holding tank and the filler valve in one of the flow paths, the flowmeter being operative to control all filler valves.

ADVANTAGES

By employing but a single flowmeter and causing it to control the supply of contents via all flow paths, the apparatus according to the invention is of economical design and construction, which, despite its simplicity, satisfies the requirements placed on the desired volume precision, particularly during lengthy running.

BRIEF DESCRIPTION OF THE ACCOMPANYING DRAWINGS

One preferred embodiment of the apparatus according to the present invention will now be described in greater detail hereinbelow, with particular reference to the accompanying, schematic Drawings which show only those details essential to an understanding of the present invention. In the accompanying Drawings:

FIG. 1 schematically illustrates the apparatus according to the present invention from the side and partly in section;

FIG. 2 shows, on a larger scale, a part of the apparatus as shown in FIG. 1, partly in section; and FIG. 3 is a section taken through a reducer according to FIG. 2.

DESCRIPTION OF PREFERRED EMBODIMENT

Figure 1:
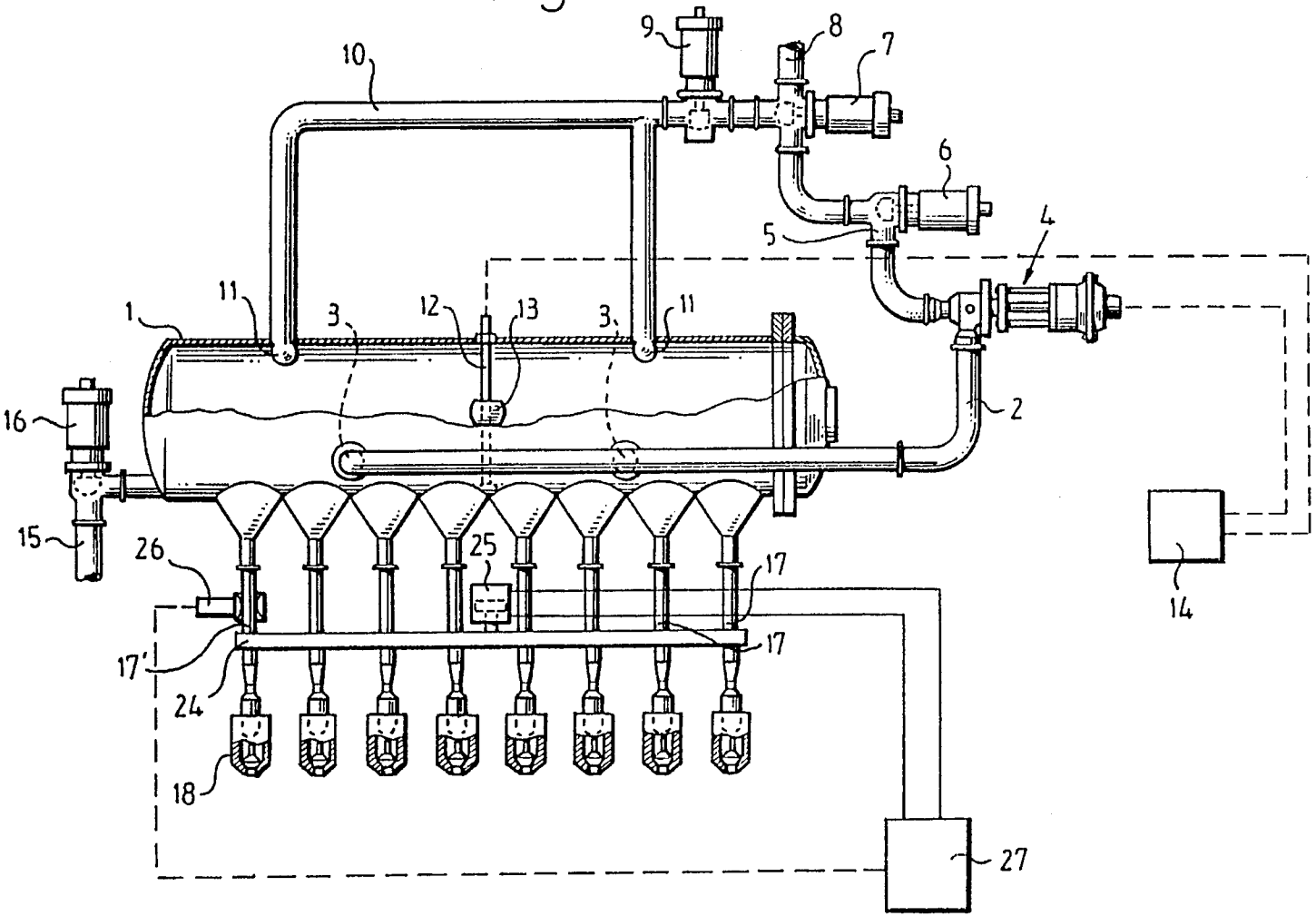
Figure 2:
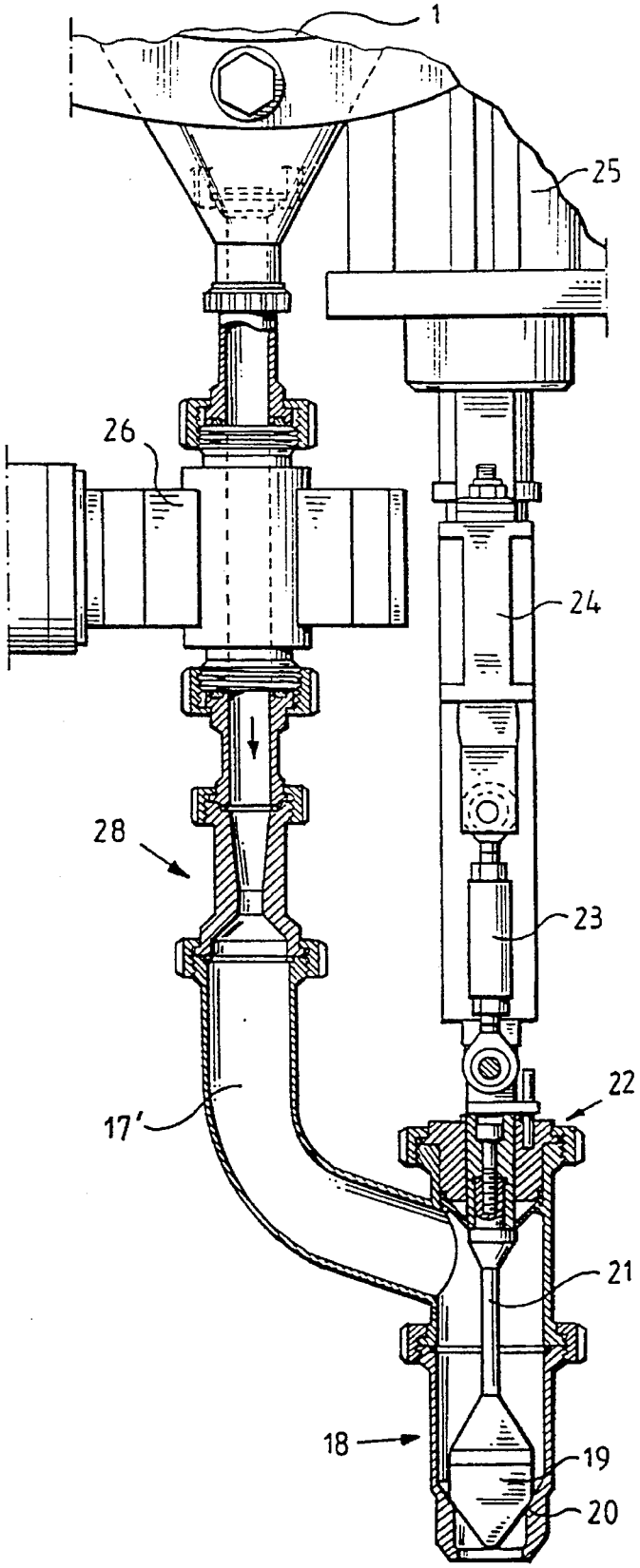

An embodiment of the apparatus according to the present invention which is shown on the Drawings is intended for simultaneous filling of eight packaging containers or bottles which, by means of conveyor devices (not shown), are placed in filling position beneath the apparatus. The apparatus may be integrated in a larger packing machine, but it is also possible to employ the apparatus according to the present invention for filling packaging containers which are advanced stepwise on a conveyor. The practical design of the apparatus may, of course, be modified within broad limits as long as the fundamental construction of the apparatus remains unchanged and falls within the spirit and scope of the appended claims.

The apparatus according to the present invention for simultaneous filling of a plurality of packaging containers comprises an elongate holding tank 1 which has convex end walls and is designed as a pressure tank so as to withstand a certain inner excess pressure. The volume of the tank should be at least twice the total volume of those packaging containers which are filled simultaneously. A larger tank volume is to be preferred, since the level on intermittent tapping of contents with then vary to a lesser degree than would be the case if a small tank is employed. At one end wall of the holding tank 1, there extends an inlet pipe 2 disposed axially along the bottom of the tank and displaying two outlet holes 3 spaced along the length of the tank. The opposing end of the inlet pipe 2 is in communication with a flow regulator 4 in the form of a pump or a valve which, via a further pipe 5, a washing valve 6 and an inlet valve 7, is connected with an intake 8 for the intended contents. The intake 8 may be connected to a main reservoir (not shown) or to some other type of source for the intended contents.

Using the inlet valve 7 the intake 8 can, when the system is washed, be connected via a further washing valve 9, to a washing conduit which discharges at two spaced-apart points in the upper region of the holding tank 1 where the washing conduit 10 is connected to two so-called sprinkler roses 11, i.e., ball-shaped outlet nozzles which are perforated on their surface and are of the type which is normally employed for spreading washing and cleaning liquid for the cleaning of tanks (CIP processes).

Centrally in the holding tank 1, there is also disposed a level meter 12 which, for example, can operate together with a float 13 whose position is transmitted electrically to an exteriorly disposed level regulator 14 of the known type which is employed to control a valve or pump in response to a signal, i.e., in the present case the flow regulator 4. Naturally, other types of level meters 12 may also be employed, for example level probes or different types of signal transmitters and signal receivers.

The holding tank 1 also displays a drainage conduit 15 discharging from the lower region of the tank and closable by means of a bottom valve 16.

At the lower region of the holding tank 1, there is provided a number of aligned outlets to flow paths 17 which extend substantially vertically downwards to filler valves 18 disposed at the lower ends of the flow paths. The housing of each filler valve contains a vertically displaceable valve body 19, a valve seat 20 disposed at the lower end of the valve body, and a substantially vertically upwardly extending spindle 21 carrying the valve body. The spindle 21 or its extension is, via sealing members 22 at the upper end of the filler valve, in communication with a linkage 23 whose upper end is in turn pivotally connected to a transfer beam 24. The transfer beam extends horizontally over all valves 18 and is, via corresponding linkages 23, connected to each one of the valves so as to make for concerted operation by vertical displacement of the beam 24. The beam 24, which is journalled in a known manner (not shown on the Drawings) for permitting operation, is actuated by a prime mover 25 in the form of a piston and cylinder unit which is connected to the beam 24 for displacing the beam between a lower position in which all valve bodies 19 abut against their valve seat 20 so that the filler valves 18 are closed, and an upper position in which the valve bodies 19 are spaced from their respective valve seat 20 so that contents may freely flow from the holding tank 1, via the flow paths 17 and out through each respective filler valve 18 to packaging containers (not shown) disposed beneath the valves.

In order to permit controlling of the filler valves 18 so that a suitable, uniform metering of contents can be ensured, there is disposed, in one of the flow paths 17', a flow meter 26 which is of conventional type and electrically meters the volume of liquid passing in the flow path 17'. The flow meter 26 is electrically connected to a control device 27 which may be of the known type which is employed for operating, for instance, a piston and cylinder unit of the type which constitutes the prime mover 25.

Each one of the flow paths 17 further includes a reducer 28 which is mounted in the flow path between the holding tank 1 and the filler valve 18. In the flow path 17' fitted with the flow meter 26, the reducer 28 is mounted downstream of the flow meter 26 seen in the direction of flow of the contents.

Figure 3:
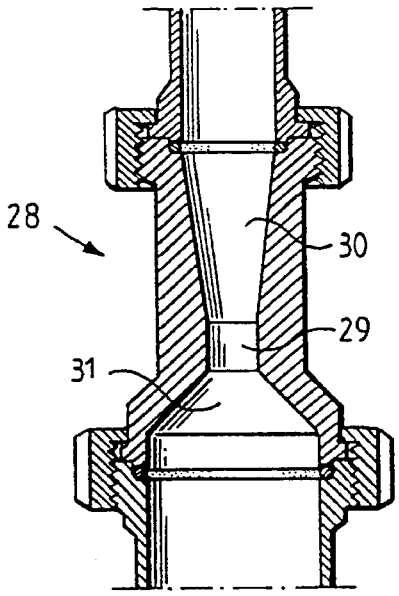

The reducer 28, which is shown on a larger scale in FIG. 3, is in the form of a washer or throttle with a channel 29 of an area which is reduced in relation to the area of the flow path 17, with the result that the through flow area of the reducer 28 is less than 50% of the average area of the flow path 17. Upstream of the channel 29, seen in the direction of flow of the contents, the reducer 28 presents an inlet cone 30 which forms a transition between the larger flow area in the flow path 17 and the reduced area of the channel 29. The reducer 28 is also provided with an outlet cone 31 located downstream of the channel 29 and forming a transition to the larger flow area in the section of the flow path 17 located after the reducer 28. The inlet cone 30 displays an entry angle of between 5° and 20°, while the outlet cone 31 has an angle of flare of between 60° and 180°. Naturally, these values are adapted to that type of contents which is to be filled, as well as the quantity of contents to be batched every time the filler valves 18 are opened. On filling of freely flowing contents, for example milk, into one liter packages, it has proved appropriate to employ an inlet cone 30 which has a top or entry angle of approx. 10°, while the outlet cone 31 should, given similar conditions, display a flare angle of approx. 90°.

As a result of the presence of the reducer 28—which is of decisive importance to the flow resistance in the flow paths 17—it will be possible to balance all flow paths so that a substantially completely uniform flow resistance occurs, which ensures a uniform filling despite the fact that only a single flow path 17' is provided with a flowmeter 26 and is operative, via the control device 27, simultaneously to control all filler valves 18 in a uniform manner. Possible imbalances in the flow resistance depending upon the differing placement of the flow paths in relation to the centre of the holding tank, inaccuracies in the design of the flow paths and their inner surfaces, the presence of a flowmeter 26 in but a single one of the flow paths, as well as other conceivable factors of influence can be completely cancelled out by individual design of the different reducers 28. When these have thus been given such design that a uniform flow is obtained in all flow paths, control of the content volume can be guaranteed with a satisfactory degree of accuracy (approx.±2% volume accuracy) for a very long period of running time.

In operation, contents are fed via the intake 8, the washing valve 9 being closed so that the contents reach the flow regulator 4 via the pipe 5 and the open washing valve 6. Depending upon the position of the regulator 4, the contents are permitted to flow via both outlet holes 3 of the inlet pipe 2, into the holding tank, where the surface of the liquid lifts the float 13 until the level meter 12 emits, via the level regulator 14, a signal to the flow regulator 4 to discontinue or throttle the inflow of contents in the holding tank 1.

When the conveyor (not shown) has placed eight upwardly open, preformed packaging containers beneath the filler valves 18, the control device 27 receives a signal so that the prime mover 25 is actuated to raise the beam 24 to its upper position, in which event the linkages 23 actuate the valve bodies 19 to the upper, open position. Hereby, contents may flow via the flow paths 17 and filler valves 18 so that filling of the packaging containers is commenced. When the flowmeter 26 has registered that the desired volume of contents has passed in the flow path 17', a signal is once again emitted to the control device 27 to close the filler valves 18, all packaging containers having, thanks to the symmetric flow in the different flow paths 17, received the predetermined volume of contents with a high degree of precision. The outflow of contents via the flow paths 17 affects the level in the holding tank 1 which is registered by the level meter 12 so that the flow regulator 4 is ordered to permit intake of the volume shortfall of contents into the holding tank. It will hereby be ensured that the liquid pressure in the different flow paths 17 is always kept within certain limits, at the same time as a sufficient quantity of contents for subsequent filling cycles is always available in the holding tank. Of course, the holding tank 1 also includes an air bleeder aperture (not shown) so that its inner volume is in contact with the ambient atmosphere via a suitable filter, but it is also possible to pressurize, via the bleeder aperture, the holding tank so as to permit an increase of the flow rate in the flow paths 17 when the filler valves 18 open. Similarly, a slight excess pressure in the holding tank 1 may be employed when contents of a higher viscosity are to be filled, e.g., juice or cordial of a thicker consistency. Hereby, the apparatus according to the present invention can be employed not only for freely flowing, water-like contents, but also for a large number of the most commonly occurring packed drinks.

In practice, the apparatus according to the present invention has proved to function well and entail considerable cost savings, since a large number of flow paths can be controlled from a single flowmeter, instead of the necessity, as previously, of utilizing the same number of flowmeters as the number of flow paths, or alternatively a corresponding number of active dispensing devices such as piston pumps or the like. This simplification implies not only a considerable cost saving in connection with design, construction and manufacture of the apparatus, but also entails that after-sales service and monitoring are simplified and made more economical, since the apparatus contains very few moving or adjustable parts.

The present invention should not be considered as restricted to that described above and shown on the Drawings, many modifications being conceivable without departing from the spirit and scope of the appended claims.

What is claimed is:

1. An apparatus for filling a plurality of containers with a liquid, comprising:

a holding tank for holding a quantity of liquid;

a plurality of filler pipes connected to the holding tank;

a plurality of filler valves, each filler valve corresponding to one of the plurality of filler pipes;

signal generating means, located between the holding tank and one of the filler valves in one of the plurality of filler pipes, for generating a signal after a predetermined amount of liquid has flowed through the filler pipe; and closing means, responsive to the signal generated by the signal generating means, for closing the plurality of filler valves, wherein the signal generating means includes a flowmeter and the closing means includes a control device and a prime mover, the prime mover including a piston and cylinder assembly, for the plurality of filler valves associated with the control device.

2. The apparatus as claimed in claim 1, wherein the prime mover is common to all of the plurality of filler valves.

3. The apparatus as claimed in claim 1, wherein each filler pipe includes a reducer arrangement.

4. The apparatus as claimed in claim 3, wherein a through flow area of each reducer arrangement is less than 50% of an average cross-sectional area of an associated one of the filler pipes.

5. The apparatus as claimed in claim 3, wherein each reducer includes a channel of reduced area, the channel having inlet and outlet portions which flare outwardly in opposite directions.

6. The apparatus as claimed in claim 5, wherein the inlet and outlet portions are conical.

7. The apparatus as claimed in claim 1, wherein the holding tank includes a level meter for controlling a flow-regulating device disposed in an inlet path of the tank, the flow-regulating device controlling flow of liquid into the holding tank in response to a signal generated by the level meter such that, when liquid is removed from the holding tank through the filler pipes, additional liquid is allowed to enter the holding tank.

8. An apparatus for filling a plurality of containers with liquid, comprising:

a holding tank for holding a quantity of liquid;

a plurality of filler pipes attached to the holding tank, each filler pipe including a filler valve, each filler valve allowing flow of liquid from the holding tank through the valve when open and stopping flow through the valve when closed;

signal generating means, associated with one of the filler pipes, for generating a signal when a predetermined amount of liquid has flowed through the one of the filler pipes; and closing means, responsive to the signal generated by the signal generating means, for closing the plurality of filler valves, wherein the signal generating means includes a flowmeter and the closing means includes a control device and a prime mover, the prime mover including a piston and cylinder assembly, for the filler valves associated with the control device.

9. The apparatus as set forth in claim 8, wherein each filler pipe includes means for limiting an amount of liquid flowing through the filler pipe such that liquid flow per unit time through each of the filler pipes is the same.

10. A method for filling a plurality of containers with liquid, comprising the steps of:

simultaneously opening a plurality of filler valves in a corresponding plurality of filler pipes;

generating a signal when a flowmeter detects that a predetermined amount of fluid has flowed through one of the filler pipes; and simultaneously closing the plurality of filler valves with a closing means including a control device for receiving the signal and a prime mover for the filler valves associated with the control device, the prime mover including a piston and cylinder assembly, in response to the signal that the predetermined amount of fluid has been detected.

11. The method as set forth in claim 10, comprising the further step of limiting flow through each of the filler pipes such that an equal amount of fluid flows through each of the filler pipes over a given period of time.

12. The method as set forth in claim 10, wherein the plurality of filler valves are simultaneously opened the prime mover.

* * * * *